US008813846B2

(12) United States Patent
Babadagli et al.

(10) Patent No.: US 8,813,846 B2
(45) Date of Patent: Aug. 26, 2014

(54) HYDROCARBON RECOVERY PROCESS FOR FRACTURED RESERVOIRS

(75) Inventors: Tayfun Babadagli, Edmonton (CA); Al-Muatasim Al-Bahlani, Edmonton (CA)

(73) Assignee: The Governors of the University of Alberta, Edmonton, Alberta (CA)

( * ) Notice: Subject to any disclaimer, the term of this patent is extended or adjusted under 35 U.S.C. 154(b) by 108 days.

(21) Appl. No.: 13/121,682

(22) PCT Filed: Oct. 5, 2009

(86) PCT No.: PCT/CA2009/001366

§ 371 (c)(1),
(2), (4) Date: Mar. 29, 2011

(87) PCT Pub. No.: WO2010/040202

PCT Pub. Date: Apr. 15, 2010

(65) Prior Publication Data

US 2011/0174498 A1 Jul. 21, 2011

(30) Foreign Application Priority Data

Oct. 6, 2008 (CA) ..... 2639997

(51) Int. Cl.
*E21B 43/00* (2006.01)
*E21B 43/24* (2006.01)

(52) U.S. Cl.
CPC ..... *E21B 43/2408* (2013.01)
USPC ..... 166/305.1; 166/272.3

(58) Field of Classification Search
CPC ..... E21B 43/00; E21B 43/16; E21B 43/26; E21B 43/24
USPC ..... 166/305.1, 266, 272, 303
See application file for complete search history.

(56) References Cited

U.S. PATENT DOCUMENTS

| | | | | |
|---|---|---|---|---|
| 3,280,909 | A * | 10/1966 | Closmann et al. | 166/272.3 |
| 3,288,212 | A | 11/1966 | O'Brien et al. | |
| 3,444,930 | A | 5/1969 | Williams et al. | |
| 3,881,550 | A * | 5/1975 | Barry | 166/272.6 |
| 3,908,762 | A * | 9/1975 | Redford | 166/402 |
| 3,945,435 | A | 3/1976 | Barry | |
| 4,004,636 | A | 1/1977 | Brown et al. | |

(Continued)

FOREIGN PATENT DOCUMENTS

| | | |
|---|---|---|
| CA | 982934 | 2/1976 |
| RU | 2151862 | 6/2000 |

OTHER PUBLICATIONS

Alikhan,A.A., S.M. Farouq Ali, "Oil recovery by hydrocarbon slugs driven by a hot water bank", Society of Petroleum Engineers Journal, Dec. 1971, 11:342-350.

(Continued)

*Primary Examiner* — Angela M DiTrani
*Assistant Examiner* — Silvana Runyan
(74) *Attorney, Agent, or Firm* — Buchanan Nipper

(57) ABSTRACT

Steam-Over-Solvent Injection in Fractured Reservoirs (SOS-FR) is carried out by treating a fractured hydrocarbon bearing formation penetrated by a well with a first phase of injecting a formation compatible aqueous fluid into the fractured hydrocarbon bearing formation through the well, a second phase of injecting a hydrocarbon solvent into the fractured hydrocarbon bearing formation through the well and at least a third phase of repeating the first phase after the second phase.

12 Claims, 12 Drawing Sheets

(56) References Cited

U.S. PATENT DOCUMENTS

| | | | | | |
|---|---|---|---|---|---|
| 4,034,812 | A | | 7/1977 | Widmyer | |
| 4,068,716 | A | | 1/1978 | Allen | |
| 4,280,559 | A | * | 7/1981 | Best | 166/303 |
| 4,344,485 | A | | 8/1982 | Butler | |
| 4,469,177 | A | | 9/1984 | Venkatesan | |
| 4,484,630 | A | * | 11/1984 | Chung | 166/272.3 |
| 4,513,819 | A | | 4/1985 | Islip et al. | |
| 4,519,454 | A | | 5/1985 | McMillen | |
| 4,687,058 | A | | 8/1987 | Casad et al. | |
| 4,822,481 | A | * | 4/1989 | Taylor | 208/390 |
| 4,848,466 | A | * | 7/1989 | Lin | 166/402 |
| 4,884,635 | A | | 12/1989 | McKay et al. | |
| 5,014,783 | A | * | 5/1991 | McClure | 166/270.1 |
| 5,899,274 | A | | 5/1999 | Frauenfeld et al. | |
| 6,230,814 | B1 | | 5/2001 | Nasr et al. | |
| 6,662,872 | B2 | * | 12/2003 | Gutek et al. | 166/272.4 |
| 6,769,486 | B2 | | 8/2004 | Lim et al. | |
| 2006/0289157 | A1 | | 12/2006 | Rao | |

OTHER PUBLICATIONS

Hatiboglu, C.U. "Primary and secondary oil recovery from different-wettability rocks by countercurrent diffusion and spontaneous imbibition", SPE Reservoir Evaluation & Engineering, Apr. 2008, 11:418-428.

Zhao, L., "Steam alternating solvent process", SPE Reservoir Evaluation & Engineering, Apr. 2007, 10:185-190.

Nasr, T.N. "Novel Expanding Solvent-SAGD Process "ES-SAGD"", Journal of Canadian Petroleum Technology; Jan. 2003, vol. 42, No. 1; p. 13-16.

Nasr, T.N."Steam Alternating Solvent Process: Lab Test and Simulation"; Journal of Canadian Petroleum Technology; Sep. 2005, vol. 44, No. 9; p. 37-43.

International Search Report/Written Opinion, PCT/CA2009/001366, Apr. 15, 2010.

* cited by examiner

HYDROCARBON RECOVERY PROCESS FOR FRACTURED RESERVOIRS

TECHNICAL FIELD

Recovery of hydrocarbons from underground formations.

BACKGROUND

Carbonate reservoirs introduce great challenges due to their complex fabric nature (low matrix permeability, poor effective porosity, fractures) and unfavorable wettability. These challenges are further displayed when combined with increased depth and low grade oil (low API and high viscosity). A huge amount of oil is contained in such reservoirs without any technological breakthrough for improving the recovery efficiently.

The main recovery mechanism in fractured carbonate reservoirs is matrix-fracture interaction. The most proven approach to produce heavy-oil reservoirs is through thermal means, specifically speaking steam injection. Yet, the typical reservoir engineering approach is based on mobility increase by reducing oil viscosity through effective heating, and by producing oil through viscous and gravity displacement. This is valid in homogeneous sandstones. Carbonate systems, which are fractured in general, introduce rock complexity at different scales, i.e., faults, fissures, micro fractures, vugs, poorly interconnected matrix pore structure, etc. Wettability is also a very important feature which controls the location, flow and distribution of fluids in the reservoir. When these two effects, i.e., inhomogeneous rock and unfavorable wettability, are combined with high oil viscosity, oil recovery from this type of reservoir becomes a real challenge and classic thermal application theories fail to define the displacement process.

Oil recovery from fractured carbonates relies on drainage of matrix where a great portion of oil is stored. Wettability is a critical factor controlling this drainage process in both immiscible (water or steam flooding) and miscible (solvent injection) displacement. It is essential to have a water-wet medium to drain matrix oil in fractured carbonates in immiscible processes. Carbonates, however, usually fail to meet this criterion and therefore are not eligible for this type of application. Alteration of wettability from oil-wet to water-wet may introduce technical and theoretical challenges if not well understood for specific cases. If wettability alteration occurs, it will occur mostly near the fracture and progress through the matrix as the elevated temperature front progresses through the matrix.

If waterflooding is not responding due to unfavorable wettability and low gravity of oil, recovery can be improved by reducing oil viscosity to enhance matrix drainage. As the matrix is still not water-wet enough to cause recovery by capillary imbibition, gravity is expected to be the governing force to drain oil. Thermal Assisted Gas Oil Gravity Drainage process (TA-GOGD) provides a glimpse of hope on getting better recovery by reducing matrix oil recovery. However, the project life is still long. Operationally, such recovery techniques are totally water dependent. The challenges are then not due to water injection/production only, but also on water availability and disposal. Yet, the oil recoveries are below the economical limit as the drainage is a slow process and the ultimate recovery from the matrix is expected to be relatively low.

Although part of the water may be treated and re-injected as steam, water treatment to insure 0 ppm of oil is expensive and risky for water boilers.

These theoretical and operational challenges urge for a different approach in tackling heavy-oil recovery from fractured carbonates.

SUMMARY

A new approach to improve steam/hot-water injection effectiveness and efficiency for fractured reservoirs is proposed, sometimes referred to as Steam-Over-Solvent Injection in Fractured Reservoirs (SOS-FR). The present invention comprises a new approach in producing heavy oil from carbonate reservoirs.

In an embodiment, a method of treating a fractured hydrocarbon bearing formation penetrated by a well includes a first phase of injecting a formation compatible aqueous fluid into the fractured hydrocarbon bearing formation through the well, a second phase of injecting a hydrocarbon mobilizing solvent into the fractured hydrocarbon bearing formation through the well and at least a third phase of repeating the first phase after the second phase, and producing hydrocarbons from the fractured hydrocarbon bearing formation. Hydrocarbons may be produced during the first, second and third phases and during further repeat phases.

Hence, alternating injection of steam/hot water and hydrocarbon mobilizing solvent is proposed for treatment of fractured reservoirs. Oil is produced from the matrix through thermal expansion and gravity drainage where substitution of oil by water may occur. Second, water in considered as the non-wetting phase to the matrix, which reverses the role-play in water wet reservoirs where oil is the non-wetting phase. Hydrocarbon mobilizing solvent introduction leads to complex fluid flow behaviour of imbibition (solvent→water) and drainage (water→oil) which boosts the recovery process. In addition, the process is enhanced through solvent diffusion into an oil saturated matrix improving the quality of oil. These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

A method of treating a fractured hydrocarbon bearing formation penetrated by a well includes a first phase of injecting a formation compatible aqueous fluid into the fractured hydrocarbon bearing formation through the well, a second phase of injecting a hydrocarbon mobilizing solvent into the fractured hydrocarbon bearing formation through the well and at least a third phase of repeating the first phase after the second phase.

The formation compatible aqueous fluid in each phase or embodiment described here may be water such as might be obtained from commercial supplies, including groundwater or surface water, or from a municipal system. The formation compatible aqueous fluid should be free of contaminants that could harm the formation such as fine grained materials. The formation compatible aqueous fluid may be injected as steam, cold water or hot water. Hot water is water that has a temperature, when in the formation, that is greater than the formation temperature. Hot water or steam may be produced at surface by heating the water to any suitable temperature using conventional means.

The hydrocarbon mobilizing solvent in each phase or embodiment described here may be any solvent in which hydrocarbons are soluble and which effectively mobilizes hydrocarbons. Hydrocarbon mobilizing solvents may include for example C3-C10 hydrocarbons, or mixtures of C3-C10 hydrocarbons, and may include other hydrocarbon solvents. The solvent may or may not be heated.

Figure 1:
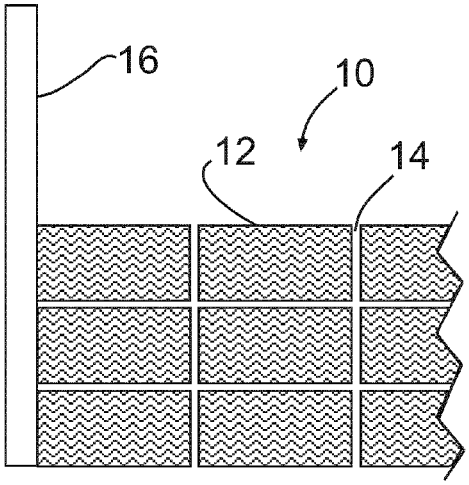
FIGS. 1-4 show steps of an initial phase of injection of formation compatible aqueous fluid for an embodiment in which the same well is used for injection and production.
Figure 2:
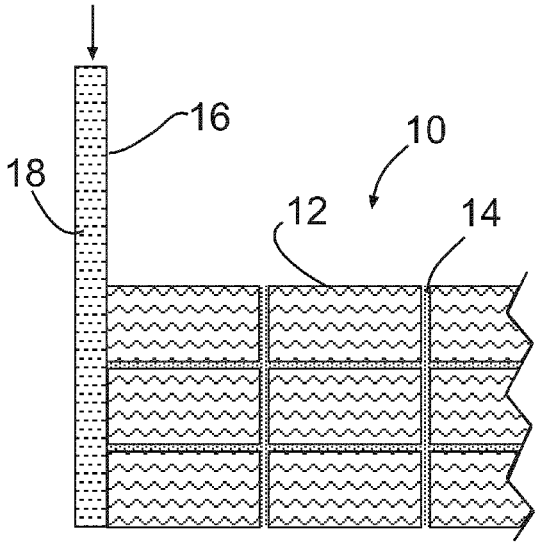
Figure 3:
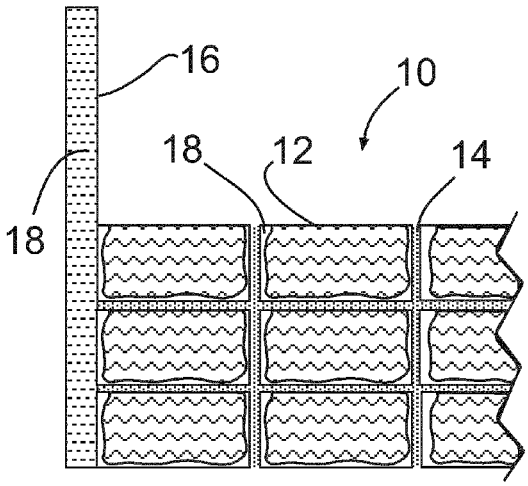
Figure 4:
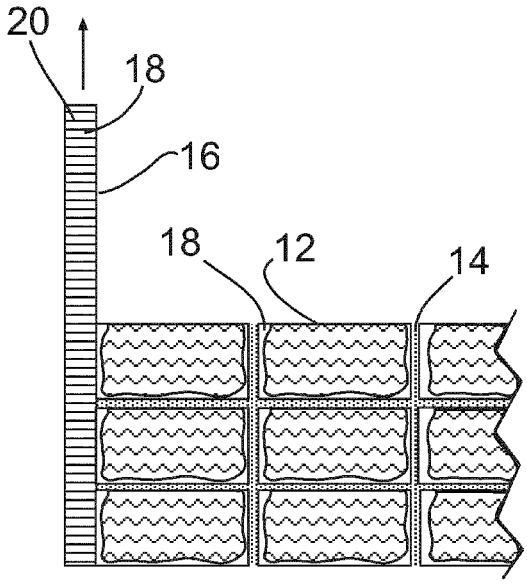

Referring to FIG. 1, a fractured hydrocarbon bearing formation 10, such as a fractured carbonate or sandstone, has a matrix 12 and fractures 14 filled with oil and is penetrated by a well 16. In FIG. 2, formation compatible aqueous fluid 18 is injected into the fractured hydrocarbon bearing formation through the well 16. The formation compatible aqueous fluid 18 penetrates the fractures 14, heats the matrix 12 and the fractures 14 fill with the formation compatible aqueous fluid and oil expelled from the matrix 12 due to thermal expansion, gravity drainage and capillary imbibition (for water wet systems). In FIG. 3, the well 16 is shut down and allowed to soak. The heated matrix 12 is filled with oil and formation compatible aqueous fluid from oil contraction during soak (and cool off) period and capillary imbibition (for water wet systems). Formation compatible aqueous fluid 18 at least partially invades the matrix 12. In FIG. 4, the well 16 is opened and the well produces oil 20 and formation compatible aqueous fluid 18.

Figure 5:
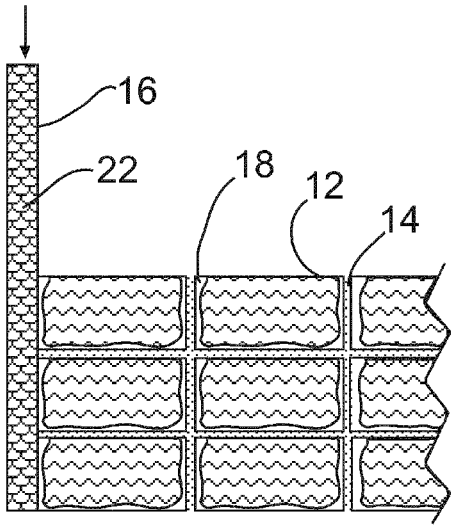
FIGS. 5-7 show steps of a phase of hydrocarbon mobilizing solvent injection for the fractured hydrocarbon bearing formation of FIGS. 1-4.
Figure 6:
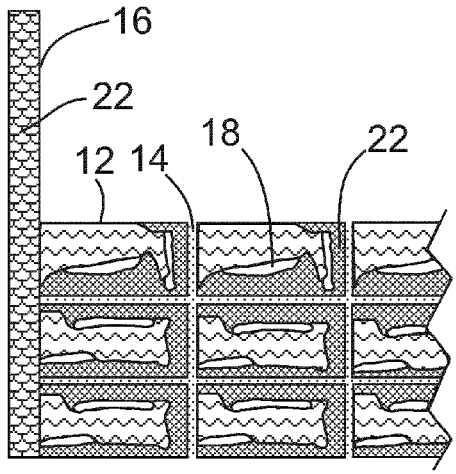
Figure 7:
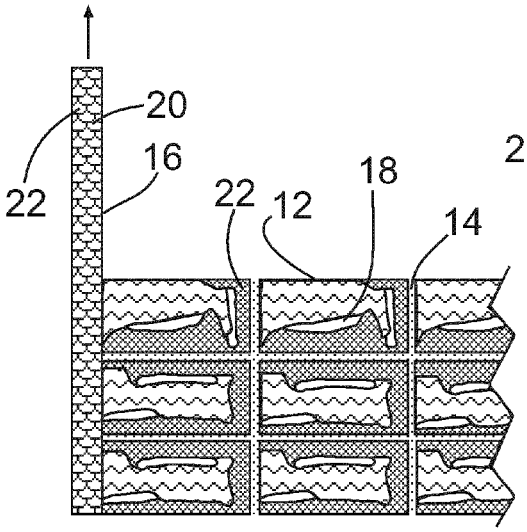

In FIG. 5, hydrocarbon mobilizing solvent 22 is injected into the fractured hydrocarbon bearing formation 10 through the well 16. The heated matrix 12 remains filled with oil 20 and formation compatible aqueous fluid 18 from oil contraction during the cool off period. The fractures 14 fill with injected hydrocarbon mobilizing solvent 22. In FIG. 6, the well 16 is closed and the fractured hydrocarbon bearing formation 12 allowed to soak in the hydrocarbon mobilizing solvent 22. The heated matrix 12 is filled with oil 20, oil and diffused solvent mixture 22, formation compatible aqueous fluid 18 from the formation compatible aqueous fluid injection and imbibing solvent 22 (for oil wet systems). The fractures 14 are filled with a mixture of oil and solvent, formation compatible aqueous fluid draining from the matrix 12 and solvent 22. In FIG. 7, the well 16 is opened and allowed to produce a mixture of oil 20 and hydrocarbon mobilizing solvent 22 until the oil rate of production declines, for example to uneconomic values. The heated matrix 12 is filled with oil, oil and diffused hydrocarbon mobilizing solvent mixture, injected formation compatible aqueous fluid and imbibing solvent (for oil wet systems). The fractures 14 drain oil, a mixture of solvent and original oil, formation compatible aqueous fluid and solvent 22 into the well 16.

Figure 8:
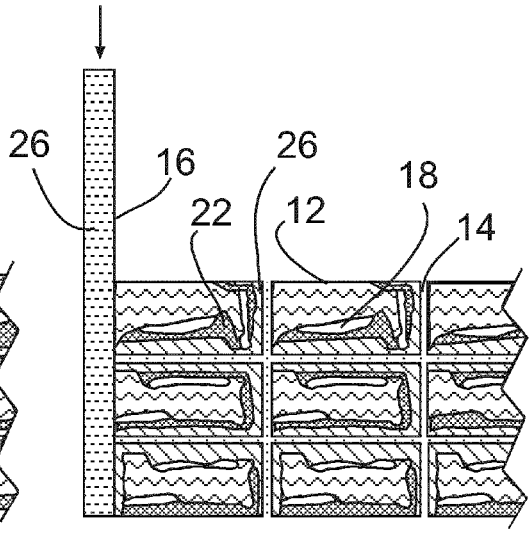
FIGS. 8-10 show steps of a phase of further formation compatible aqueous fluid injection for the fractured hydrocarbon bearing formation of FIGS. 1-4.
Figure 9:
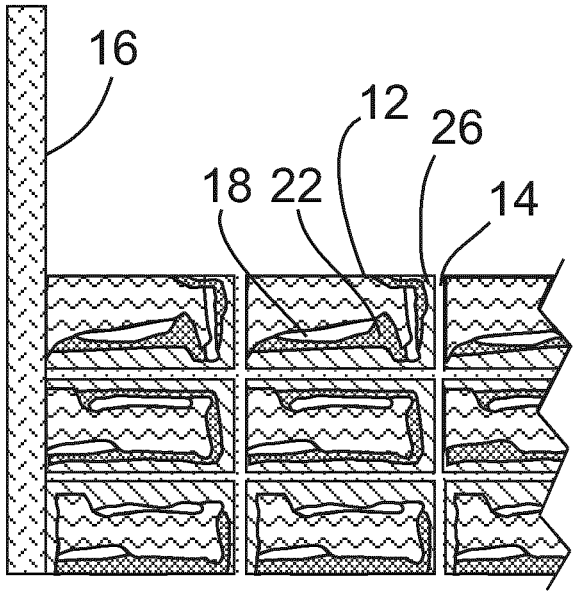
Figure 10:
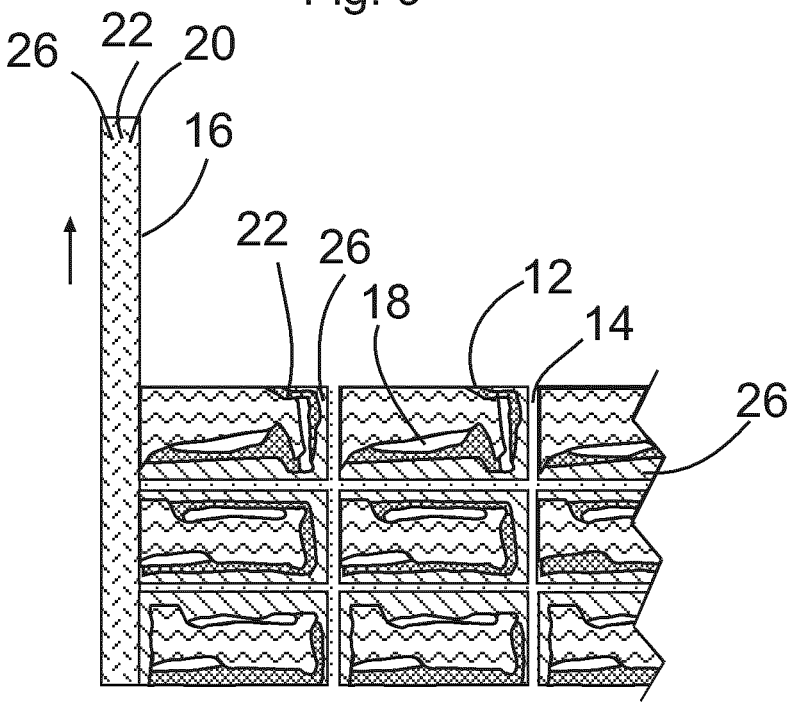

In FIG. 8, a further phase of injection of formation compatible aqueous fluid 26 into the fractured hydrocarbon bearing formation 10 through well 16 re-heats the matrix 12 and fills the fractures 14 with formation compatible aqueous fluid 26 and hydrocarbon mobilizing solvent 22. In FIG. 9, well 16 is shut down and the fractured hydrocarbon bearing formation allowed to soak. The heated matrix 12 imbibes formation compatible aqueous fluid 26 due to reduced interfacial tension and altered wettability and includes draining oil and solvent 22 mixture, which drains by gravity and capillary imbibition. The fractures 14 include formation compatible aqueous fluid 26, and solvent 22 and oil 20 mixture from the matrix 12. In FIG. 10, a third phase of production is carried out with the well 16 open. The production includes a mixture of oil 20, hydrocarbon mobilizing solvent 22 and formation compatible aqueous fluid 26. The heated matrix 12 contains draining oil 20 and solvent 22 mixture (by gravity drainage and capillary imbibition due to reduced interfacial tension and altered wettability). The fractures 14 are filled with formation compatible aqueous fluid 26 and solvent 22 and oil 20 mixture, which is produced through the well 16.

Figure 11:
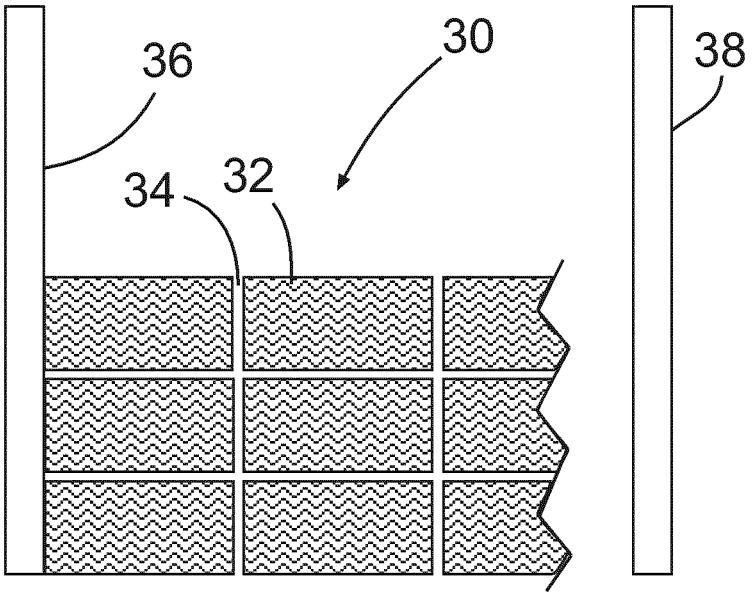
FIGS. 11-12 show steps of an initial phase of injection of formation compatible aqueous fluid for an embodiment tin which the different wells are used for injection and production.
Figure 12:
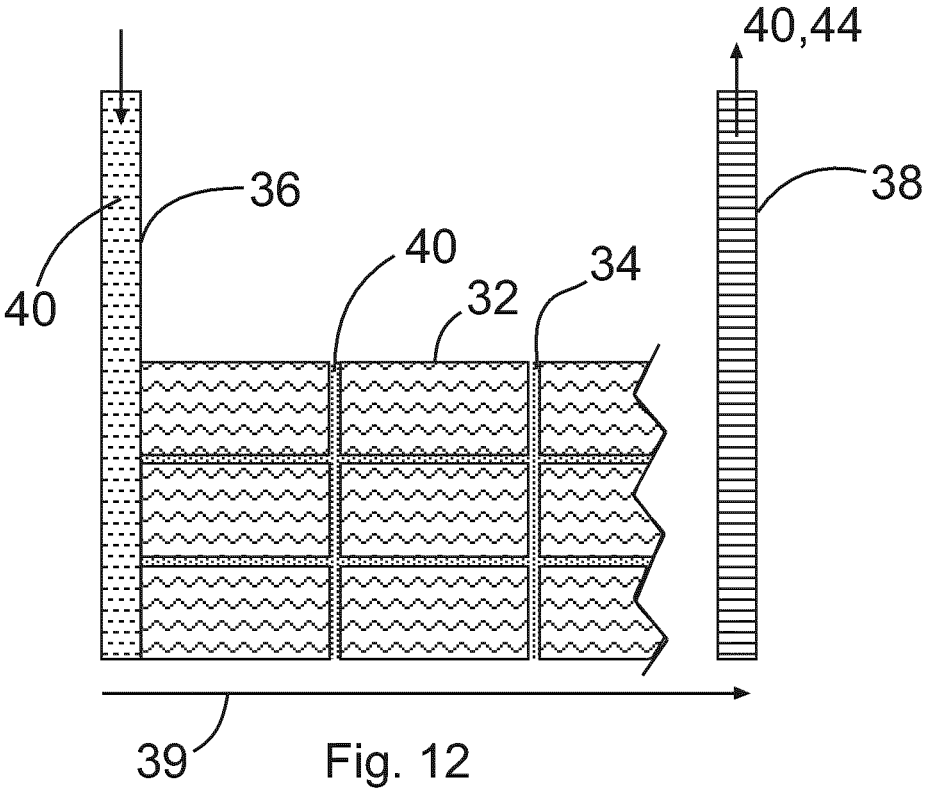
Figure 13:
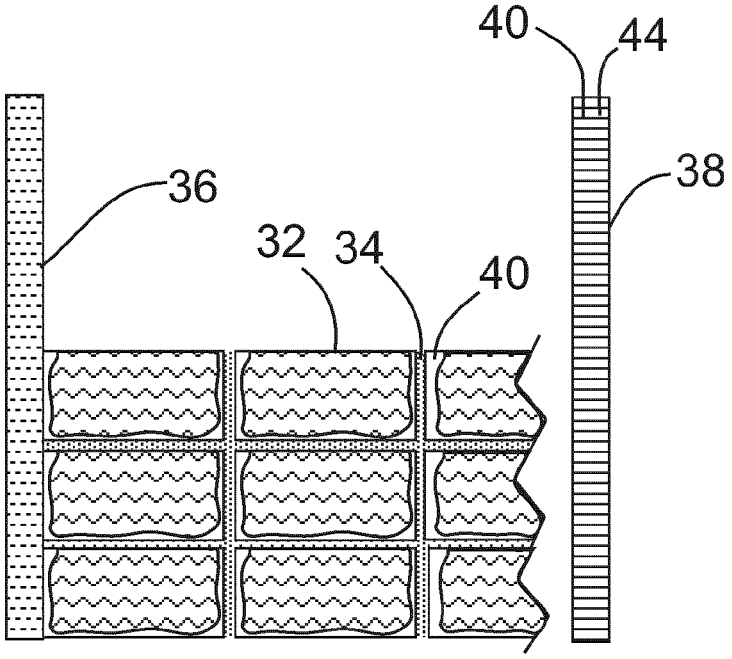
FIGS. 13-14 show steps of a phase of hydrocarbon mobilizing solvent injection for the fractured hydrocarbon bearing formation of FIGS. 11-14.

In FIG. 11, an injector well 36 penetrates a fractured hydrocarbon bearing formation 30 that has an oil filled matrix 32 and fractures 34. A production well 38 spaced from the injector well 36 by a distance determined by the field operator also penetrates the fractured hydrocarbon bearing formation 30. In FIG. 12, formation compatible aqueous fluid 40 is injected through well 36 into the fractured hydrocarbon bearing formation 30. The matrix 32 becomes heated along with the oil that it contains. The fractures 14 fill with formation compatible aqueous fluid 40 and oil expelled from the matrix 30 due to thermal expansion, gravity drainage and capillary imbibition (for water wet systems). Some formation compatible aqueous fluid 40 is produced from the production well 38 along with oil 44. Formation compatible aqueous fluid 40 flows through the fractured hydrocarbon bearing formation 30 as illustrated by arrow 39, cooling as it goes. In FIG. 13, the wells 36 and 38 are shut down and the fractured hydrocarbon bearing formation 30 allowed to soak and cool. The heated matrix 32 is filled with oil and formation compatible aqueous fluid 40 from oil contraction during cool off period and capillary imbibition for water wet systems. The fractures 34 fill with formation compatible aqueous fluid 40 and oil expelled from the matrix 32 due to thermal expansion, gravity drainage and capillary imbibition for water wet systems. The well 38 produces a mixture of oil 44 and water 40.

Figure 14:
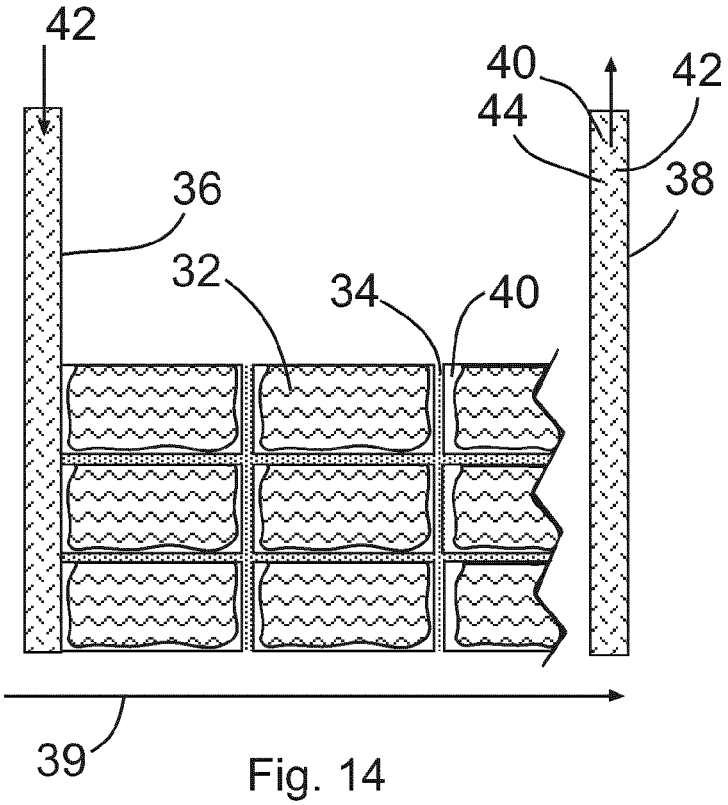
Figure 15:
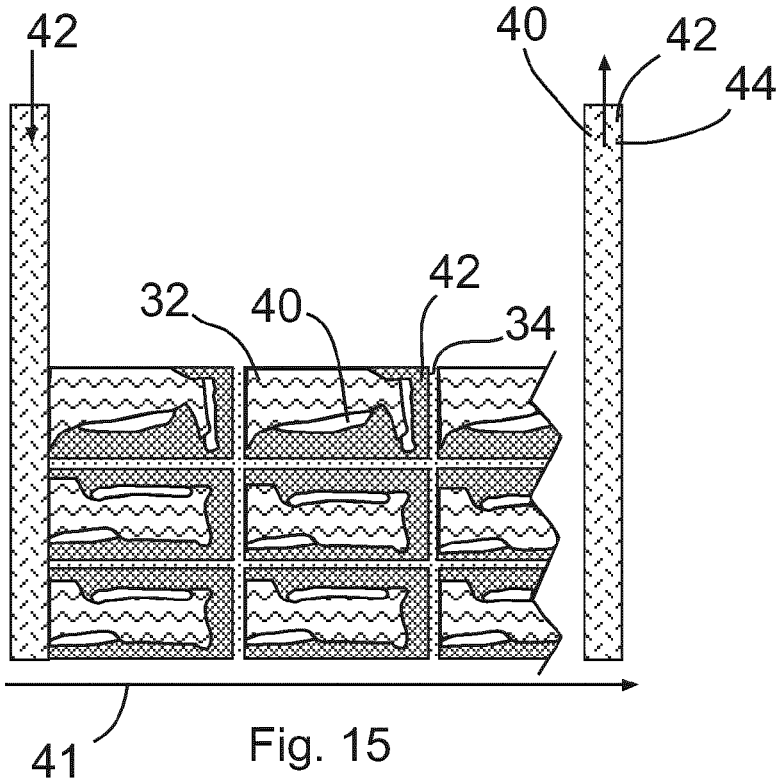
FIGS. 15-16 show steps of a phase of further formation compatible aqueous fluid injection for the fractured hydrocarbon bearing formation of FIGS. 11-14.

In FIG. 14, hydrocarbon mobilizing solvent 42 is injected through injection well 36, while production well 38 is open. Solvent 42 flows through the fractured hydrocarbon bearing formation 30 as indicated by the arrow 41. The heated matrix 32 is filled with oil and formation compatible aqueous fluid 40 from oil contraction during the cool off period, and from capillary imbibition for water wet systems. The fractures 34 are filled with solvent 42. Solvent 42 is produced from well 38 along with some formation compatible aqueous fluid 40. In FIG. 15, injection of hydrocarbon mobilizing solvent 42 into well 36 is continued at a relatively low rate compared with injection of formation compatible aqueous fluid 40. The heated matrix 32 is filled with oil, oil and diffused solvent 42 mixture, formation compatible aqueous fluid 40, and imbibing solvent for oil wet systems. The fractures 34 contain oil (mixture of oil 44 and solvent 42), formation compatible aqueous fluid 40 and solvent 42 that drains into the production well 38 and is produced. Solvent 42 injection continues until oil production declines to an uneconomic level.

Figure 16:
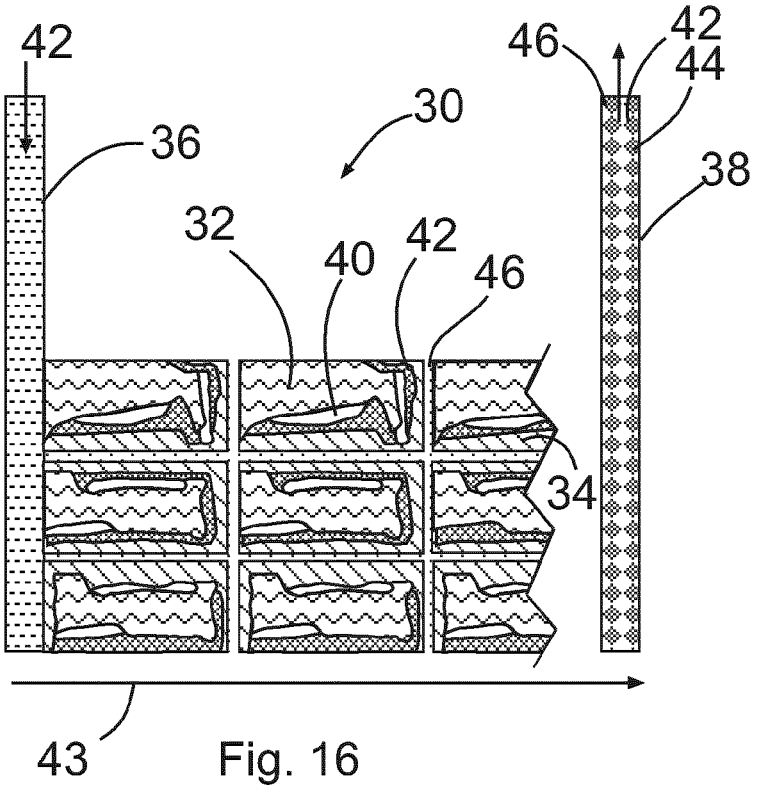

In FIG. 16, a further phase of injection of formation compatible aqueous fluid 46 begins. The object of this phase is to recover hydrocarbon mobilizing solvent 42 as well as re-heat the fractured hydrocarbon bearing formation 30. Formation compatible aqueous fluid 46 is injected into well 36 from where it flows through the fractured hydrocarbon bearing formation 30 as indicated by the arrow 43 to the open production well 38 where it is produced along with oil 44 and solvent 42. The heated matrix 32 contains draining oil, solvent 42 and formation compatible aqueous fluid 40. The fractures 34 contain formation compatible aqueous fluid 40, solvent 42 and draining oil. Injection of formation compatible aqueous fluid 46 continues until a desirable amount of solvent 42 is recovered and the field operator judges that further oil production is uneconomical in this phase.

At the conclusion of the third phase, a repetition of the first phase, as illustrated in FIGS. 10 and 16, a further phase of hydrocarbon mobilizing solvent injection may be started, and the process repeated for as long as the process is economical.

Figure 17:
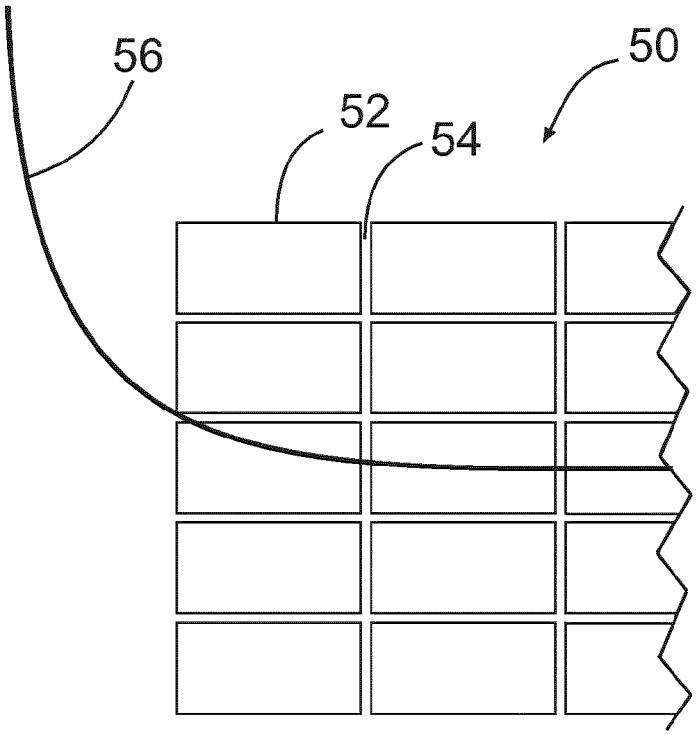
FIGS. 17-19 show additional examples well configurations.
Figure 18:
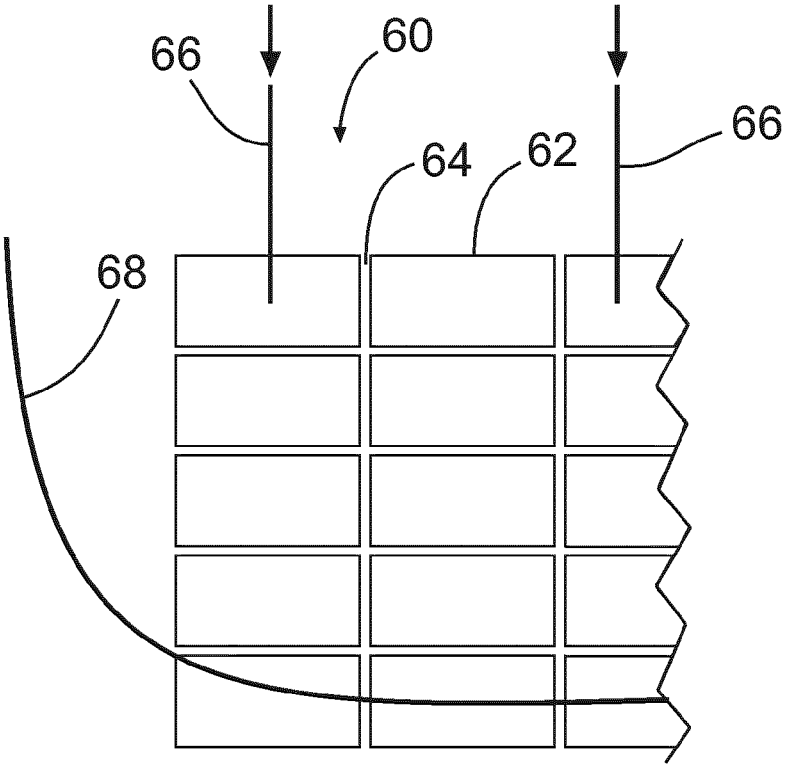
Figure 19:
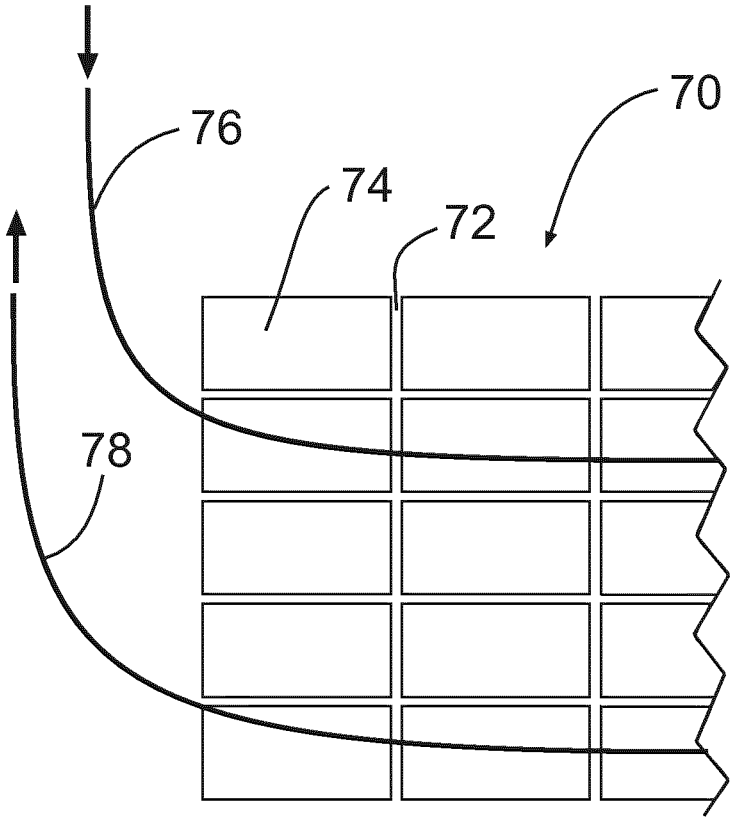

While the method is illustrated using predominantly vertical wells, the process may also be used in predominantly horizontal wells, either used singly, in pairs, or any suitable distribution. Hence, as shown in FIG. 17, the repeated phases of the methods described here may be applied to a single horizontal well 56 that penetrates a formation 50 with an oil filled matrix 52 and fractures 54, where the well 56 acts as an injection and production well, as in FIGS. 1-10. As shown in FIG. 18, the repeated phases of the methods described here may be applied to plural injection wells, that may for example be vertical wells 66 that penetrate a formation 60 with an oil filled matrix 62 and fractures 64. Production may be from a horizontal well 68 that penetrates the formation 60. As shown in FIG. 19, the repeated phases of the methods described here may be applied to horizontal injection 76 and production wells 78 that penetrate a formation 70 with an oil filled matrix 72 and fractures 74. In this configuration, the production well 78 is typically below the injection well 76. The method steps taught in relation to vertical wells are carried out in the same manner for horizontal wells or combined horizontal and vertical wells. Horizontal wells are particularly beneficial where there are vertical fractures or the formation is thick.

In a test of the proposed method, static imbibition experiments were run on Berea sandstone and carbonate cores with different wettabilities and for different oil viscosities ranging between 200 cp and 14,000 cP. For wettability alteration, cores were either aged or treated by a wettability altering agent. The experiments were conducted initially in imbibition cells in a 90° C. oven to mimic the matrix-fracture interaction in steam condensation zones. Due to its high boiling point, heptane was selected as the solvent and the core samples were exposed alternately to high temperature imbibition and solvent diffusion. The main ideas behind this process were to enhance capillary and gravity interaction by reducing viscosity (heat and solvent effect) and altering wettability (solvent effect). The results showed that further reduction in oil saturation due to solvent diffusion process preceded by hot water is remarkably fast and the ultimate recovery is high. The magnitude of recovery depends on wettability and the amount of water existing in the core. It was also observed that solvent retrieval is a very fast process and may increase to 85-90% depending on core type, wettability, and saturation history.

Each of the first phase and second phase may continue for some period of time, for example a week or a month or more, and collectively repetitions of the first phase and second phase can be expected to continue for more than a year or several years until further production is uneconomical. Formation compatible aqueous fluid may include non-damaging contaminants such as solvent, particularly in an initial phase, but for effective use in post-solvent phases the formation compatible aqueous fluid should have very little, and in most cases, no solvent.

The results obtained from the initial static experiments showed the viability of this technique. We then extended this work to more detailed experiments under static conditions::

1. We examined the effect of different types of hydrocarbon as solvent: Different paraffinic solvents were tested for the cost (and the efficiency) of the process.

2. We Ran experiments under different matrix boundary conditions and identified the contribution of different recovery mechanisms, especially gravity drainage.

3. We explored the physics of the process through core experiments and analog experiments on "Hele-Shaw like" glass models.

Static experiments may reveal some information about the viability of the process but they are run under "infinite supply" of injectant like water, steam, or solvent, as the samples were soaked into the cells filled with these fluids. Soaking time is important for the solvent injection phase especially (Phase 2) as the solvent diffusion into the matrix is a rather slow process. This can be achieved through cyclic injection but enough solvent may not be supplied through this method as needed. Then, dynamic injection accelerates the process, but suitable injection rate range should be selected for the efficiency of the process. Therefore, we performed dynamic experiments to compare the results in terms of the process time and the amount of solvent injected to finally make a decision about the field scale applications.

The cores used for these experiments were 3"×1" Berea sandstone plugs taken out of the same block and two carbonate cores from a producing oilfield. Sandstone samples were treated initially with a siliconizing fluid which acts as a wettability alteration agent. This agent is a short chain, clear polymeric silicone fluid consisting primarily of dichlorooctamethyltetrasiloxane. When applied to glass, quartz or similar materials, the unhydrolyzed chlorines present on the chain react with surface silanols to form a neutral, hydrophobic and tightly bonded film over the entire surface (Surfasil™ product website June 2009). In this process, the core was placed inside a core holder and vacuumed. Then, a solution of Toluene or Heptane +10% siliconizing fluid was introduced into the core under a vacuum. The process was repeated until around 5 PV of fluid was passed through the core. The core was then flushed with pure solvent to remove any excess siliconizing fluid that did not adhere onto the rock surface. A flush of another 5 PV of Methanol was then passed through the core to allow for siliconization of the siliconizing fluid on the grain surface. The core was then placed inside the oven for 24 hours to allow for evaporation of excess fluid and to cure the siliconizing fluid. All cores were then saturated under a vacuum in a hot bath (90° C.) for one week and allowed to age in ambient conditions for another 10 days—at least—to ensure complete oil-wetness.

The apparatus and materials used for static experiments were; (1) graduated imbibition cylinders for phase 1 and phase 3, (2) 250 ml graduated cylinders filled with 50 ml of selected solvent for phase 2, (3) gas condenser and hot water bath for phase 3, (4) sensitive scale, (5) Heptane, decane, kerosene, light crude oil mixed with Heptane.

The procedure for the static experiments was as follows:

Phase 1—After the cores were fully saturated, they were weighed and the oil initially in place was measured. The cores were then placed inside an imbibition cell and immersed into 90° C. hot water. They were then placed inside a convection oven, readings were initially taken on daily basis, however, as the cores reached near plateau they were allowed further time to ensure total plateau from the first phase. Once they reached their plateau, they were taken out and allowed to cool down before initiating the second phase.

Phase 2—The cores were then placed into 250 ml graduated cylinders and filled with 50 ml of solvent per cycle. After each cycle, a solvent reading was taken through a refractometer and the amount of oil produced was calculated through oil/solvent refractometer correlation. Weight, volume and density measurements of core and solvent were also taken. The core was then immersed in a new 50 ml of solvent. The initial target was to leave the cores in the solvent for 9 days total, however, due to technical difficulties in initiating the third phase, some cores took a longer time in the solvent. Yet, this did not affect the final conclusion, as will be discussed later.

Phase 3—After final measurements of Phase 2 were taken, the cores were immersed into hot water. The temperature ranged from 90 to 95° C. depending on the type of solvent. The imbibition cell was connected to a gas condenser in an attempt to collect and analyse the type of gas coming out from the core during this phase.

The purpose of the dynamic experiment was to test the rate effect of solvent injection into the fracture on the total production. For this purpose, a core holder with a rubber sleeve was used to place the rock piece that was artificially fractured by cutting it in the middle and saturated it with oil. Hot water and heptane were injected through two constant rate pumps. A heating unit consisting of a coil-tube immersed in an oil bath and temperature controller was used to generate hot water. Temperatures were measured at the inlet and outlets through two thermocouples and a data acquisition system. To compensate for the heat losses, a heating tape was used to keep the temperature inside the core holder, which was insulated by glass wool. 180 psi overburden was applied to prevent injected fluid flowing from through the gap between the rubber sleeve and the core sample.

Initially a large amount of steam was injected at a rate of 2 cc/min (CWE) to produce most of the oil through steam. The system was then left to cool with a minimal cold water injection of 0.25 cc/min (CWE). Subsequently, solvent was injected at three different rates: 0.1, 0.3, and 0.5 cc/min. The injection stopped either after reaching a plateau or completion of nine hours. The third phase was then initiated where steam was injected at the rate of 2 cc/min. For the third phase, a tower was attached to the production line in an attempt to allow any gas to condense and drop down. Weight measurements were taken and refractometer readings were taken to quantify the production.

For the glass model experiments, two glass slides were treated with the same chemical wettability alteration agent used for the rocks to make them hydrophobic following the procedure explained above. This represents a small scale "Hele-Shaw like" model. The slides were glued together using a high temperature oil resistant epoxy with a spacing of 38 μm and then saturated through oil instantaneous imbibition.

The objective of the "Hele-Shaw like" glass model experiments is to visually clarify the mechanicals involved in the process and explore the hypothesis that a complex imbibition-drainage reverse role play is apparent during the second phase. This is mainly due to water intrusion into the system during the cooling period after Phase 1. Reduced temperature causes the contraction of oil and the equivalent volume of water in the system penetrates into the rock. This water acts as a non-wetting phase and when rock is exposed to solvent, we expect not only solvent diffusion through oil in the system, but also solvent imbibition displacing water. This complicates the process but in practical applications, a certain amount of water is expected to be in the system after Phase 1. This could be an obstacle to the solvent to contact with oil and diffuse into it. On the other hand, water is the non-wetting phase and it can be displaced by solvent imbibition and solvent can get into the core through this mechanism.

For reasons of practicality, light oil is used instead of heavy oil in the glass model experiments. This also allowed for the elimination of any asphaltene precipitation effect, which may occur due to the presence of heptane and also provide better visualization. After the model was saturated it was placed in a 90° C. water bath to allow for thermal expansion. The model was then placed in cold water with fluorescent tracer. Finally, the model was placed in a heptane bath and photos were taken every five seconds.

As was initially stated, one of the objectives of static experiments was to test the effects of types of solvents on the process. Solvent cost is a critical issue in this process and as the carbon number increases the solvent cost decreases. Also, as the molecular weight of the solvent increases, the amount of oil recovery decreases.

Figure 20:
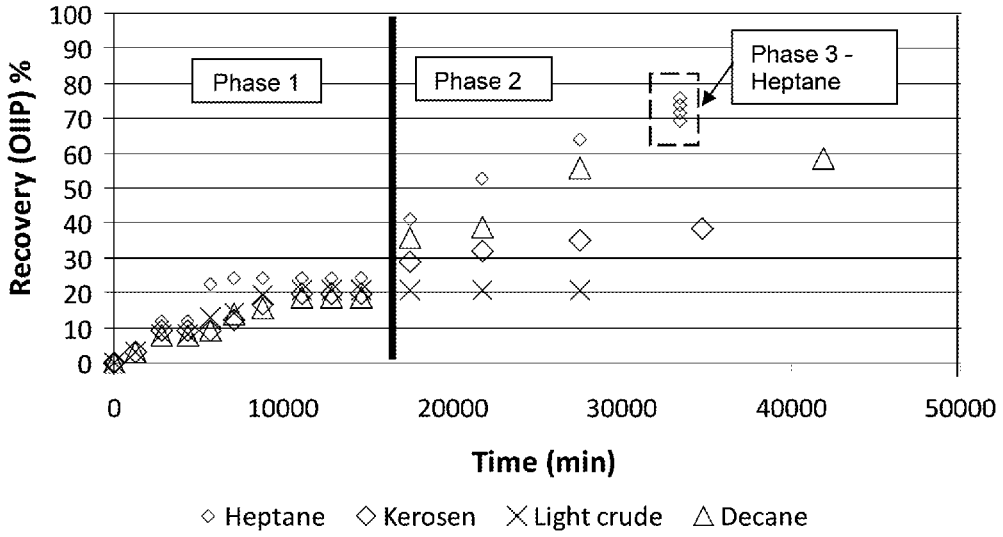
FIG. 20 shows oil recovery with different solvents in static tests.

Different carbon number paraffinic solvents were tested in the experiments. As can be seen in FIG. 20, different recovery mechanisms are expected in Phase 1. For all cases, an initial plateau was reached at around 12% OOIP and then it increased again until it reached a plateau around 20% OOIP. It is apparent that the initial recovery mechanism is thermal expansion and it was followed by gravity drainage accelerated by the reduced viscosity under elevated temperature. Thermal expansion is very fast but the gravity drainage is at much slower rate. No capillary imbibition is expected with this oil as the system wettability was changed to strongly oil-wet, as assured by additional wettability tests.

In the second phase, the cores were immersed into different solvents. The results are expected; the lower the carbon number, the greater the heavy-oil recovery, as shown in FIG. 20. The core used with the Decane solvent was left for a further period to test the time effect on recovery at later stages. It did not show any critical incremental recovery over a long period of time. Another interesting observation is that the refractometer showed no change in the core immersed in light crude oil, which suggests that there is no recovery by using light crude oil. Thus light crude appears not to be effective at mobilizing heavy crude, perhaps because it contains too many heavy molecules making it too similar to heavy crude.

The diffusion coefficient for light crude-heavy crude pairs is expectedly much higher than lighter solvents. But the cost of the solvent increases as the carbon number decreases. Mixing light crude with lighter hydrocarbons may make an effective hydrocarbon mobilizing solvent at a lower cost than the lighter solvent alone. The optimal mixture of crude oil and additional lighter solvent for a cost effective process may readily be found by simple experimentation as outlined in this patent document. Also, it was visually observed that asphaltene precipitation was much less with higher molecular weight solvents which yet are present.

Figure 21:
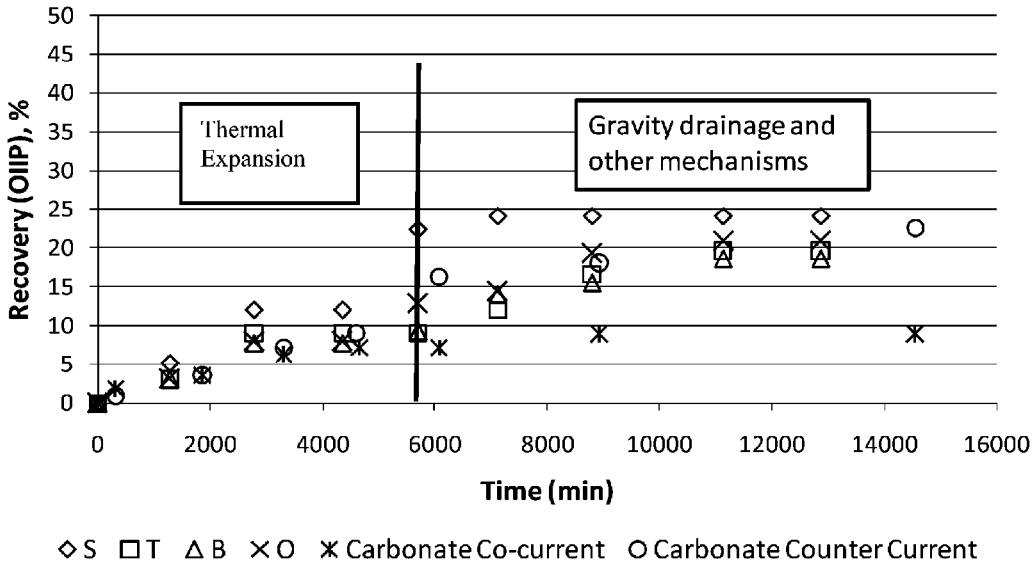
FIG. 21 show oil recovery with different rocks and boundary conditions in static tests.

FIG. 21 compares different rocks and matrix boundary conditions. The cores coded as S, T, B, and O are Berea sandstone cores treated with the wettability alteration agent. The rest are two carbonate cores: the first one is open from all sides (cocurrent) and the second one is open only from one side (counter-current).

It is evident that up to 5800 minutes, the total recovery from all cores is almost equal, as shown in FIG. 21, and this corresponds to recovery by thermal expansion. This suggests that the recovery mechanism is independent of rock property, and is only affected by fluid property during the thermal expansion portion of Phase 1. The thermal expansion recoveries varying between 7 and 13%. The later increment in recovery is expected to be by gravity drainage which can go up to 30%.

Figure 22:
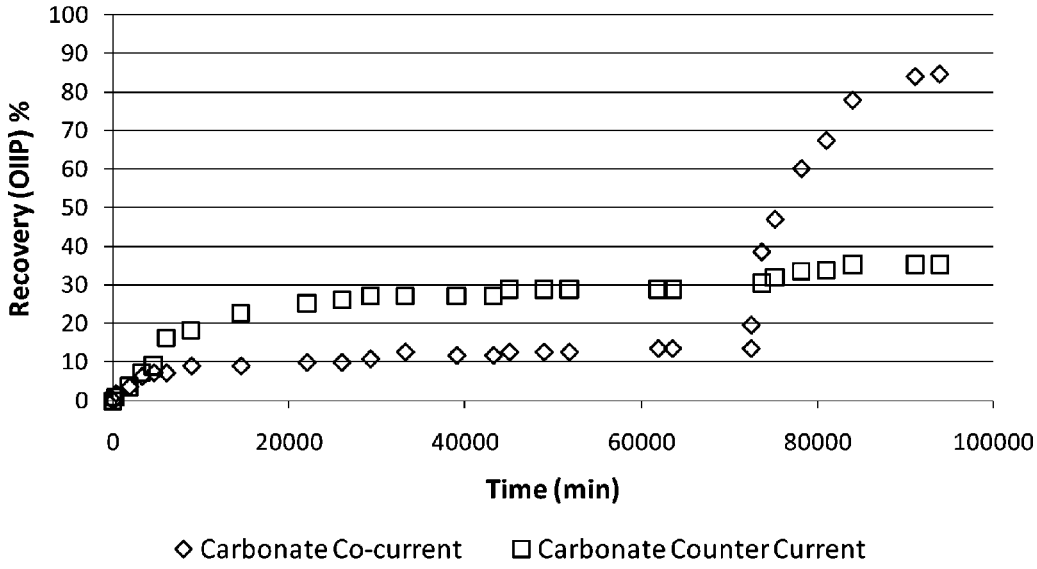
FIG. 22 shows a comparison of oil recovery from two carbonate cores, one open from all sides and one open from only one side.

Referring to FIG. 22, it can also be observed that the co-current carbonate core has produced the least amount of oil (less than 10%) over a long period compared to over 20% in the counter-current core. This also supports the idea of a gravity drainage dominated recovery period, as the sample with coating is placed open side facing down which facilitates the gravity drainage. Once again, no significant capillary imbibition is expected from any of these cores, especially the carbonate rocks.

When the second phase was initiated, the carbonate cores showed different behavior, as shown in FIG. 21. The co-current core (all sides open) produced more oil during the second phase, as shown in FIGS. 21 and 22). This was mainly due to a larger contact area with solvent which affects the diffusion process. It is worth mentioning that the open face in the counter-current core is facing upward in this case to avoid any production due to gravity segregation, which might also have a negative effect on the production of oil. After Phase 2, the counter-current core was left in the solvent for a long time and asphaltene precipitation was observed.

Note that the possibility of wettability alteration after solvent exposure (Phase 2) was tested with the co-current core by immersing it after Phase 2 into distilled water at ambient conditions over a month period. The recovery (expected to be mainly by capillary imbibition) was negligible to null, which suggests that wettability alteration was not apparent at ambient conditions even after long exposure to solvent. This can be attributed to the incapability of heptane to dissolve heavier components deposited on the pore surface. The same experiment was repeated at higher temperature (90° C.) applied in Phase 3 and significant oil recovery was observed with heptane production in the form of gas bubbles.

The proposed method can be applied in the field as cyclic or continuous injection. Each has advantages and disadvantages. Plenty of hydrocarbon mobilizing solvent supply is needed in Phase 2 and this may not be achieved through cyclic (huff and puff) type injection. It is, however, needed to have sufficient exposure time between the rock matrix and solvent, and this might be possible if the solvent is injected at optimal rates. For the hot water/steam phases (Phase 1 and 3), the supply of an aqueous phase (and heat) is also critical and a high permeability fracture effect needs to be considered as the early breakthrough of hot water/steam would reduce the efficiency of the process. Therefore, dynamic experiments were conducted to test these effects and to eventually collect enough information that might be useful towards decision making of field scale application strategies.

Figure 23:
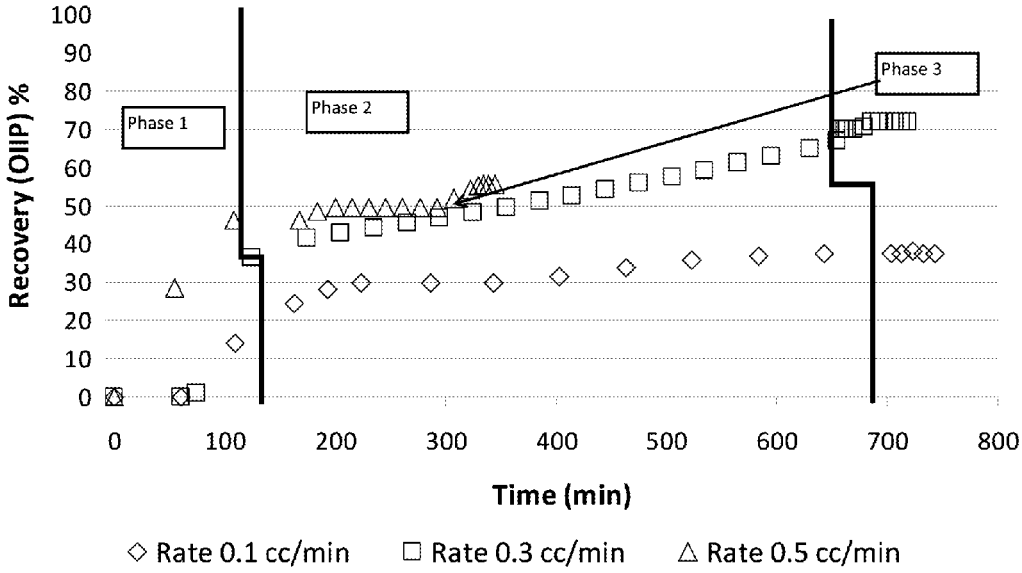
FIG. 23 shows oil recovery over time for different rates of solvent injection in dynamic experiments.
Figure 24:
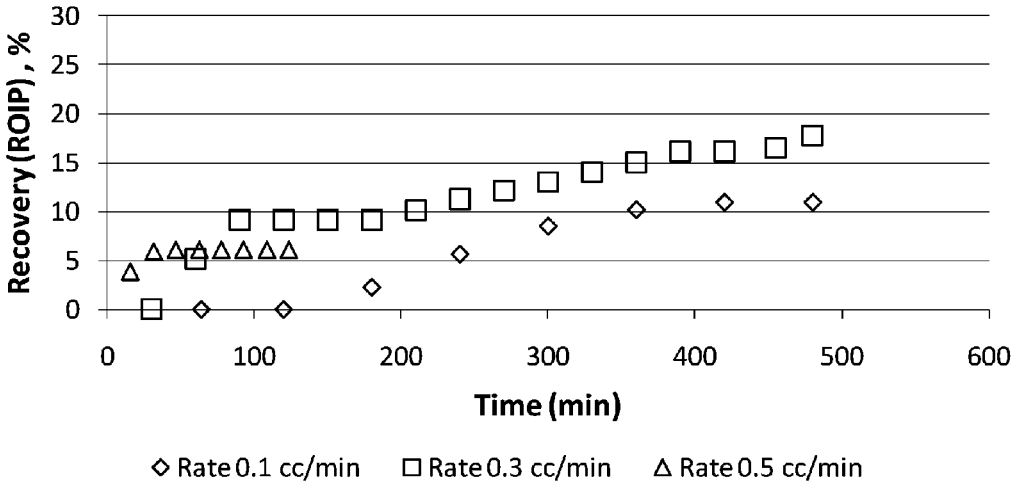
FIG. 24 shows oil recovery over time for different rates of solvent injection restricted to the phase in which solvent is being injected.

The main purpose of the dynamic experiments was to test the solvent injection rate effect during the second phase. The results are shown in FIG. 23. During the first phase, several pore volumes of hot water/steam were injected to recover oil and to heat the system. The injection rate was 2 cc/min. This rate and the amount of hot water/steam were needed as the core length was limited to 3" and this caused quick breakthrough of hot-water. Recoveries went as high as 45%, which suggests different recovery mechanisms acting at the same time in addition to thermal expansion due to injection. During Phase 2, three different rates were tested: 0.1, 0.3 and 0.5 cc/min. The highest recovery was obtained at the rate of 0.3 cc/min. The 0.5 cc/min case showed minimal recovery due to insufficient contact time with the matrix in order for the diffusion transfer to take place. This was achieved at 0.1 cc/min, but the process was slow. The process turned out to be rate dependent. For a better view, the oil recovered through Phase 2 (solvent injection) only is shown in FIG. 24.

Figure 25:
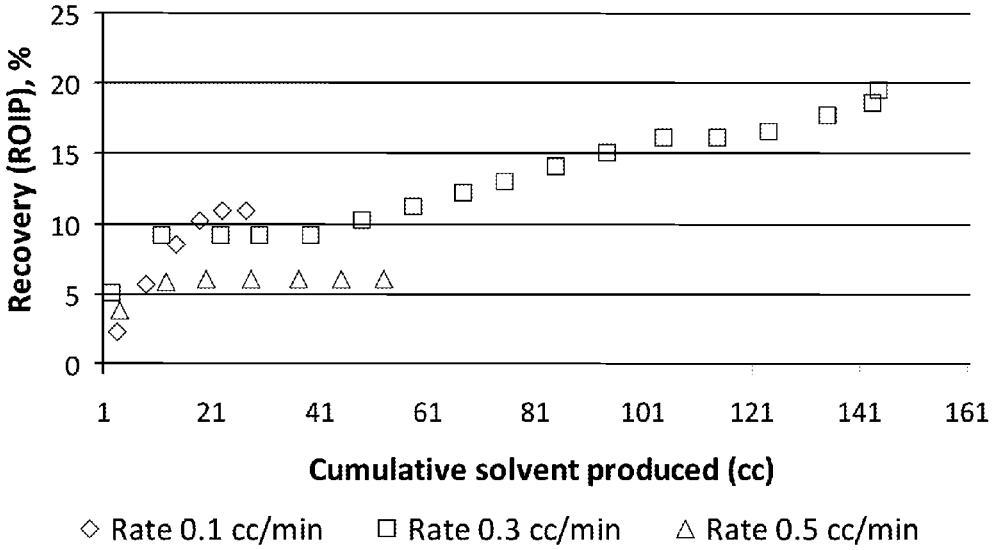
FIG. 25 shows oil recovery over the amount of solvent recovered for different rates of solvent injection in dynamic experiments.
Figure 26:
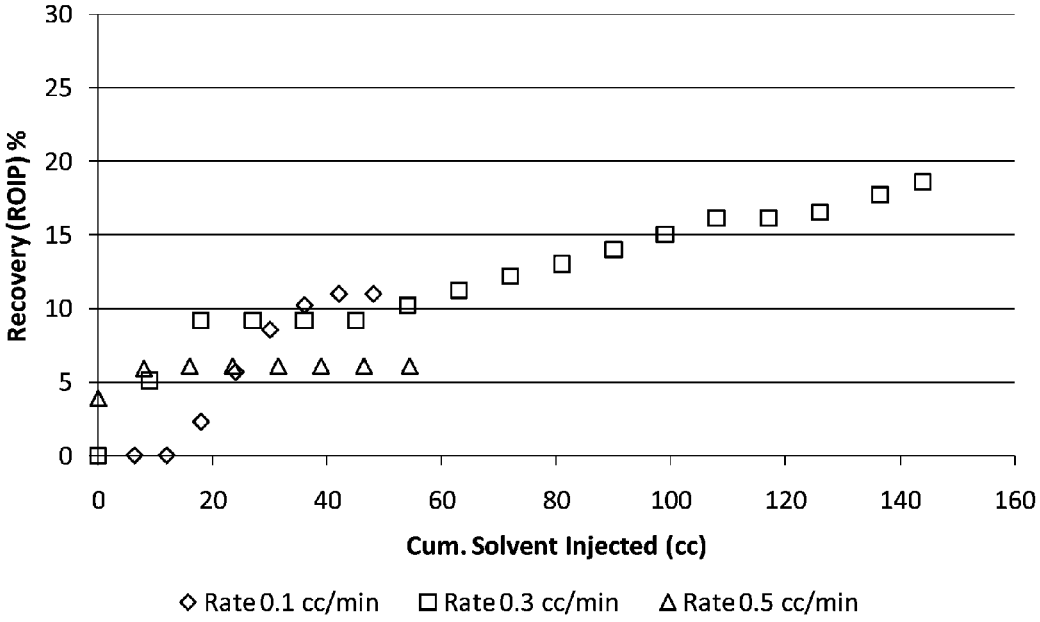
FIG. 26 shows oil recovery over the amount of solvent injected for different rates of solvent injection in dynamic experiments.

Two other plots were provided to clarify the efficiency of the process. FIGS. 25 and 26 shows the solvent produced against the recovery during Phase 2 and the cumulative solvent injected against oil recovery, respectively. Both plots suggest that lower rates are more efficient in terms of solvent use. The high rate case (0.5 cc/min) yielded a very inefficient process with low recovery (due to ineffective diffusion transfer between matrix and fracture) and excessive amount of solvent injection. When time constraint is considered, the 0.3 cc/min rate case turned out to be an optimal value (FIG. 23). These observations suggest that there exists an optimal rate to be determined on the basis of solvent, oil, and rock properties.

The most critical part after oil recovery was solvent retrieval from the system. The amount of solvent in the produced oil was calculated using a refractometer and weight/volume readings during Phase 2. It is desirable to produce the injected solvent for an efficient process and some amount of solvent will be recovered during Phase 2 as shown in FIG. 25. Based on the observations during static experiments, a great amount of solvent is expected to be retrieved in Phase 3 (hot water/steam injection). The third phase was initiated by injecting hot water/steam (90° C.) at 2 cc/min rates. Within less than one hour the whole process was completed and a great portion of solvent was retrieved at a very high rate. Note that this temperature is very close to the boiling point of heptane and the main mechanism driving solvent out of the rock matrix is boiling and a certain degree of capillary imbibition, as hot aqueous phase flows in the fracture and interfacial properties (interfacial tension and wettability) are expected to be changed as oil property in the matrix changes due to solvent diffusion and high temperature. The solvent recovered during Phase 3 was difficult to estimate as most of the solvent came out as gas at this temperature at a very high rate.

The amount of solvent and original crude oil in the produced oil was calculated. Some additional crude recovery is seen in FIG. 23 (Phase 3 portion). The 0.3 and 0.5 cc/min rates yielded additional oil recovery around 3-6% in Phase 3. This amount is slightly lower in the 0.1 cc/min case. Once again, most of the recovery was boiling heptane and oil produced by its pushing force. The mixture produced 60-70% solvent on average for three rate cases. It was possible to detect the amount of original crude oil and solvent produced through refractometer analysis. It was, however, difficult to quantify the solvent produced in the form of gas bubbles, mainly due to its high volatility. It is worth mentioning that this process was extremely fast completed in order of minutes for both static and dynamic cases as can be inferred from FIGS. 20 and 23. This is the most promising outcome of the experiments conducted as solvent retrieval is a crucial issue in this type of process.

We had some interesting observations during the dynamic experiments. The moltens produced were foamy which suggests the presence of the gas; however, a good quantification of the gas type is not yet evident. Combining observations from both static and dynamic experiments, it can be suggested that the gas leaving the core pushes out with it some of the maltenes dissolved in the solvent. This happens as a thin film created on the heptane (in the gas form) bubble, which also allows for the expulsion of fines (mainly asphaltene) precipitated inside the matrix.

The purpose of the glass model was to visually examine our hypothesis regarding the reverse role play of imbibition-drainage in an oil wet medium (Al-Bahlani and Babadagli 2008). During rock experiments, some amount of water production was observed during Phase 2. This can be free water gone into the system due to oil contraction. This water was produced by solvent imbibition into oil-wet system during Phase 2. The glass model was sealed from all sides except small openings at the lower left and lower right corners. Water invaded the sample during the cooling off period right after Phase 1.

When the same sample was immersed into solvent for Phase 2, it was observed that the solvent enters the model as fingers. Obviously water was an obstacle to solvent diffusion into the system and solvent entered the system around water and diffusion into oil developing fingers. No significant water drainage was observed due to solvent imbibition or any other displacement forces.

The glass model experiments clearly show the complexity of the process that involves several mechanisms at the same time. Mass transfer (diffusion of solvent into oil) and surface phenomena (mainly capillary imbibition) along with gravity control the matrix recovery. One may add the complexities due to thermodynamic conditions to these (temperature range is around the boiling point of solvent), and the fracture effect and flow related complexities (dispersion in the fracture and rate effects). While the process has been shown to work with specific hydrocarbon solvents, the similar properties of hydrocarbon solvents yields a sound basis for extrapolating the results to all hydrocarbon solvents capable of effectively mobilizing the hydrocarbons in the formation of interest. The person of average skill in the art may easily discover the effectiveness of a solvent at mobilizing the hydrocarbons by simple experiments such as disclosed here. The experiments comparing different solvent types show that decreasing solvent molecular number yields faster recovery. But to produce more of the higher end of the crude oil, higher solvent numbers are preferred. The ideal solvent type and composition for a particular application will depend on the particular oil and rock type.

Immaterial modifications may be made to the embodiments described here without departing from what is covered by the claims. In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

What is claimed is:

1. A method of treating a fractured hydrocarbon bearing formation penetrated by a well, the fractured hydrocarbon bearing formation having a formation temperature, a rock matrix formed of carbonate and matrix oil wetting the rock matrix, the rock matrix having fractures, the method comprising:

in a first phase, injecting a formation compatible aqueous fluid into the fractured hydrocarbon bearing formation through the well upon which the formation compatible aqueous fluid penetrates the fractures, heats the rock matrix and the fractures fill with the formation compatible aqueous fluid and matrix oil expelled from the rock matrix;

in the first phase, allowing the well to soak and cool off in a soaking period during which the rock matrix is filled with matrix oil and partially filled with formation compatible aqueous fluid from oil contraction during soak and cool off;

in the first phase, opening the well to allow production of matrix oil and formation compatible aqueous fluid;

in a second phase, injecting a hydrocarbon solvent into the fractured hydrocarbon bearing formation through the well to dilute the matrix oil by solvent diffusion into the matrix oil, the hydrocarbon solvent having a boiling point and being miscible with the matrix oil, during which second phase, the fractures fill with hydrocarbon solvent;

in the second phase, closing the well to allow the fractured hydrocarbon bearing formation to soak in the hydrocarbon solvent, while the rock matrix fills with matrix oil, matrix oil and diffused solvent mixture and formation compatible aqueous fluid;

in the second phase, opening the well to produce a mixture of matrix oil and hydrocarbon solvent, while the fractures drain matrix oil, at least in a third phase, repeating the first phase after the second phase, including the closing of the well, soaking of the fractured hydrocarbon bearing formation and production of matrix oil, in which third phase the formation compatible aqueous fluid has a temperature selected to be sufficiently close to the boiling point of the hydrocarbon solvent that boiling of the hydrocarbon solvent in the fractured hydrocarbon bearing formation in the third phase drives hydrocarbon solvent out of the rock matrix for retrieval of hydrocarbon solvent; and producing hydrocarbons from the fractured hydrocarbon bearing formation.

2. The method of claim 1 in which the formation compatible aqueous fluid has at least initially a temperature in the fractured hydrocarbon bearing formation greater than the temperature of the fractured hydrocarbon bearing formation.

3. The method of claim 1 in which the formation compatible aqueous fluid injected in the third phase is free of hydrocarbon solvent.

4. The method of claim 1 in which the formation compatible aqueous fluid is steam.

5. The method of claim 1 in which producing hydrocarbons comprises producing hydrocarbons from the well used for injection of the formation compatible aqueous fluid and hydrocarbon solvent.

6. The method of claim 1 in which producing hydrocarbons comprises producing hydrocarbons from a different well from the well used for injection of the formation compatible aqueous fluid and hydrocarbon solvent.

7. The method of claim 1 in which the well used for injection is a predominantly vertical well.

8. The method of claim 1 in which the well used for injection is a predominantly horizontal well.

9. The method of claim 1 in which the hydrocarbon solvent comprises C3-C10 hydrocarbons.

10. The method of claim 1 in which the first phase and second phase are repeated for at least a year.

11. The method of claim 1 carried out using a single well in which injecting and producing steps are carried out cyclically and repeated injecting cycles are carried out before each producing step.

12. The method of claim 1 carried out using an injection well and a production well, and injecting steps are carried out continuously with the producing step.

* * * * *